United States Patent [19]

Yasuda et al.

[11] 4,365,242

[45] Dec. 21, 1982

[54] DRIVING TECHNIQUE FOR MATRIX LIQUID CRYSTAL DISPLAY PANEL FOR DISPLAYING CHARACTERS AND A CURSOR

[75] Inventors: Shuhei Yasuda; Yutaka Ishii; Tomio Wada, all of Nara, Japan

[73] Assignee: Sharp Kabushiki Kaisha, Osaka, Japan

[21] Appl. No.: 237,702

[22] Filed: Feb. 24, 1981

[30] Foreign Application Priority Data

Feb. 25, 1980 [JP] Japan ..... 55-23003

[51] Int. Cl.[3] ..... G09G 3/36

[52] U.S. Cl. ..... 340/709; 340/752; 340/756; 340/784

[58] Field of Search ..... 340/709, 752, 756, 765, 340/771, 784

[56] References Cited

U.S. PATENT DOCUMENTS

| | | | |
|---|---|---|---|
| 3,979,718 | 9/1976 | Umeda et al. | 340/709 |
| 4,281,324 | 7/1981 | Nonomura et al. | 340/784 |
| 4,307,391 | 12/1981 | Lewis | 340/771 X |
| 4,308,534 | 12/1981 | Yamamoto | 340/752 X |

*Primary Examiner*—David L. Trafton

*Attorney, Agent, or Firm*—Birch, Stewart, Kolasch & Birch

[57] ABSTRACT

A new driving technique is disclosed for a liquid crystal display panel for displaying at least two rows of characters and a cursor line while scanning scanning lines of the panel, which technique can decrease the number of scanning lines and increases the above defined voltage margin by scanning the scanning lines each two rows at a time in a line sequential scanning fashion and skipping the scanning of a cursor line electrode in a row where a display of the cursor line is unrequired, thus ensuring good contrast and viewing angle characteristics of the panels.

3 Claims, 6 Drawing Figures

VOLTAGE MARGIN
1.8
1.7
1.6
1.5
1.4
1.3
1.2
1.1
1.0
10
20
30
40
50
60
SCANNING LINES N

DRIVING TECHNIQUE FOR MATRIX LIQUID CRYSTAL DISPLAY PANEL FOR DISPLAYING CHARACTERS AND A CURSOR

BACKGROUND OF THE INVENTION

This invention relates to a driving technique for a liquid crystal matrix display panel wherein the brightness is dependent on the effective value of an applied voltage.

It is well known that matrix display panels having signal lines and scanning lines in a matrix and a plurality of pixels at the crossings of these lines typically twisted nematic liquid crystal matrix panels possess the dependency of its brightness of respective ones of the pixels on the effective value of applied voltages thereto. For the display panels of a 5×7 dot matrix with a cursor line, an electrode structure per character (character, number, symbol or the like) is set up by five data column electrodes 1, seven scanning row electrodes 2 and a single cursor line electrode 3 as depicted in FIG. 1. The respective scanning row electrodes 2 and the cursor line electrode 3 are conventionally scanned in a line sequential fashion for displaying characters.

The greater the voltage margin given as follows the better the contrast and viewing angle characteristics of the liquid crystal panel:

$$d = \frac{V_{rms}(ON)}{V_{rms}(OFF)} = \frac{(\sqrt{N}+1)^{\frac{1}{2}}}{(\sqrt{N}-1)} \quad (1)$$

where $V_{rms}$ (ON) is the effective value of an ON voltage applied across a respective one of the liquid crystal pixels $V_{rms}$ (OFF) is the effective value of an OFF voltage applied thereto and N is the number of the scanning lines.

It is however obvious that the greater the number N of the scanning lines the smaller the voltage margin as seen from FIG. 2 which is plotted with the voltage margin against the number N of the scanning lines. With the above line sequential scanning technique which scans the single cursor line electrode 3 as well as the seven scanning row electrodes 2, the number N of the scanning lines increases with a resultant decrease in the voltage margin d. This leads to the problems with degradation of the contrast and viewing angle characteristics of the liquid crystal panel.

OBJECTS AMD SUMMARY OF THE INVENTION

Accordingly, it is an object of the present invention to provide a new driving technique for matrix liquid crystal display panels which avoids the prior art problems.

It is another object of the present invention to provide a new driving technique for a liquid crystal display panel for displaying at least two rows of characters and a cursor line while scanning the scanning lines of the panel, which technique can decrease the number of scanning lines and increases the above defined voltage margin by scanning the scanning lines each two rows at a time in a line sequential scanning fashion and skipping the scanning of a cursor line electrode in a row where a display of the cursor line is unrequired, thus ensuring good contrast and viewing angle characteristics of the panels.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 3:
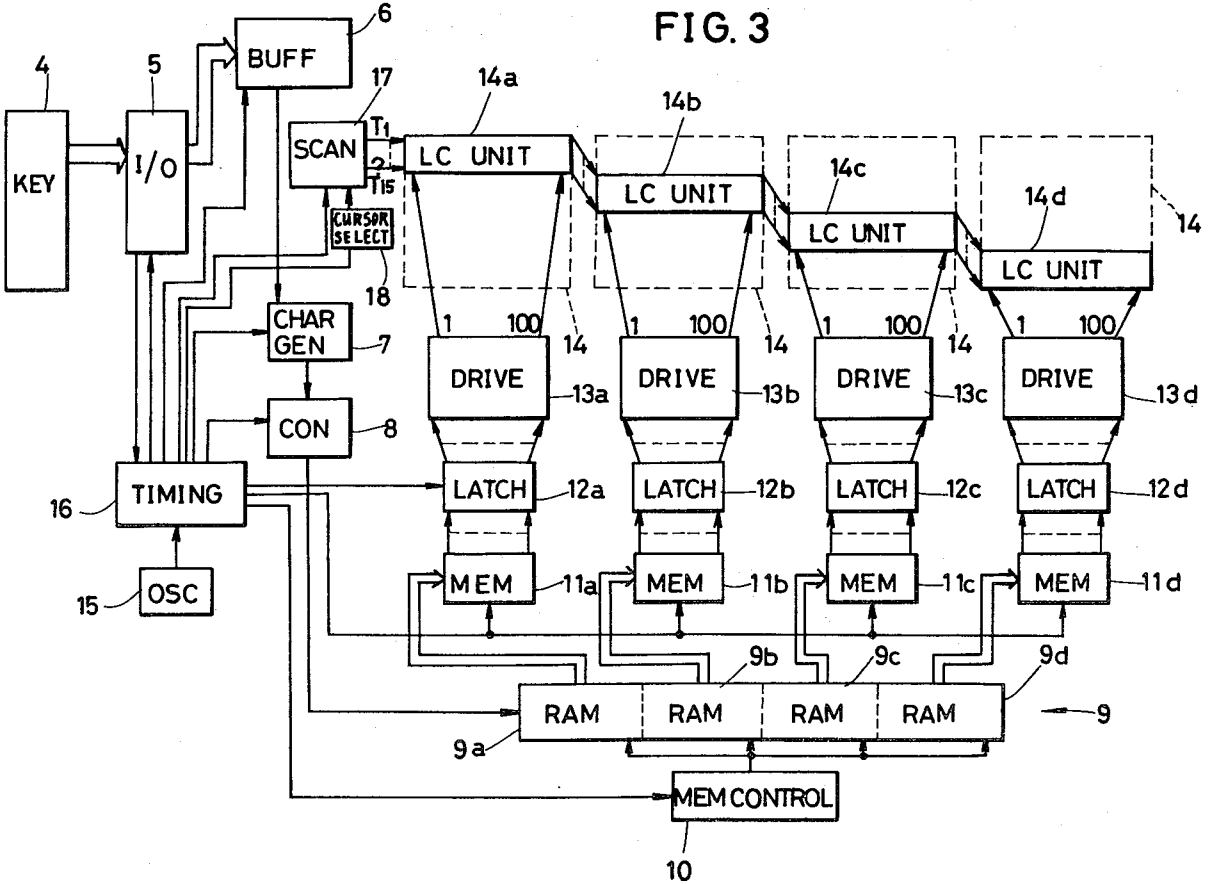
FIG. 3 is a block diagram of an embodiment of the present invention.

Referring to FIG. 3, there is illustrated a driving circuit for a 20 characters by 8 rows liquid crystal display panel for displaying characters, which includes a keyboard 4, an input/output interface 5, a character buffer memory 6, a character generator 7, a parallel-to-serial converter 8, a frame memory 9, a memory control circuit 10, line memories 11*a*, 11*b*, 11*c* and 11*d*, data latches 12*a*, 12*b*, 12*c* and 12*d*, drivers 13*a*, 13*b*, 13*c* and 13*d*, the liquid crystal panel 14, an oscillator 15, a timing control circuit 16, a scanning circuit 17 and a cursor line selector 18. The output of the keyboard 4 as an input device is supplied to the character buffer memory 6 via the imput/output interface 5. The character buffer memory 6 is a memory which temporarily stores the output of the keyboard 4 and provides its output for the character generator 7.

The character generator 7 comprises a memory typically of a read only memory (ROM) for generating desired character signals corresponding to the outputs of the keyboard 4 in response to the signals from the character buffer memory 6. The parallel outputs of the character generator 7 are converted into serial signals via the parallel-to-serial converter 8 and loaded into the frame memory 9.

The frame memory 9 has four random access memories (RAM) 9*a*, 9*b*, 9*c* and 9*d* each capable of storing 20 characters by 2 rows of the serial converted character signals under control of the memory control circuit 10. The respective outputs of the random access memories are fed to the line memories 11*a*, 11*b*, 11*c* and 11*d*.

The above-mentioned line memories 11*a*, 11*b*, 11*c* and 11*d* are buffer memories which temporarily store data signals transferred from the frame memories 9*a*, 9*b*, 9*c* and 9*d* to the column electrodes 1 of liquid crystal display panel units 14*a*, 14*b*, 14*c* and 14*d* per scanning line.

The respective outputs of the line memories 11*a*, 11*b*, 11*c* and 11*d* are supplied via the data latches 12*a*, 12*b*, 12*c* and 12*d* to the driver circuits 13*a*, 13*b*, 13*c* and 13*d* which in turn drive the respective column electrodes 1 of the liquid crystal display panel units 14*a*, 14*b*, 14*c* and 14*d* in synchronism with scanning timing signals from the scanning circuit 12 discussed in detail later.

Figure 1:
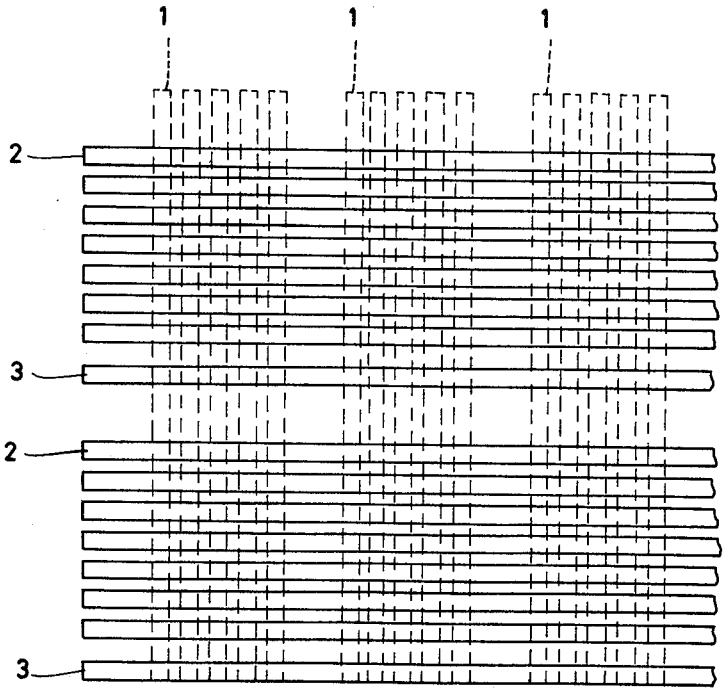
FIG. 1 is a view of an electrode scheme of a liquid crystal matrix display panel.
Figure 2:
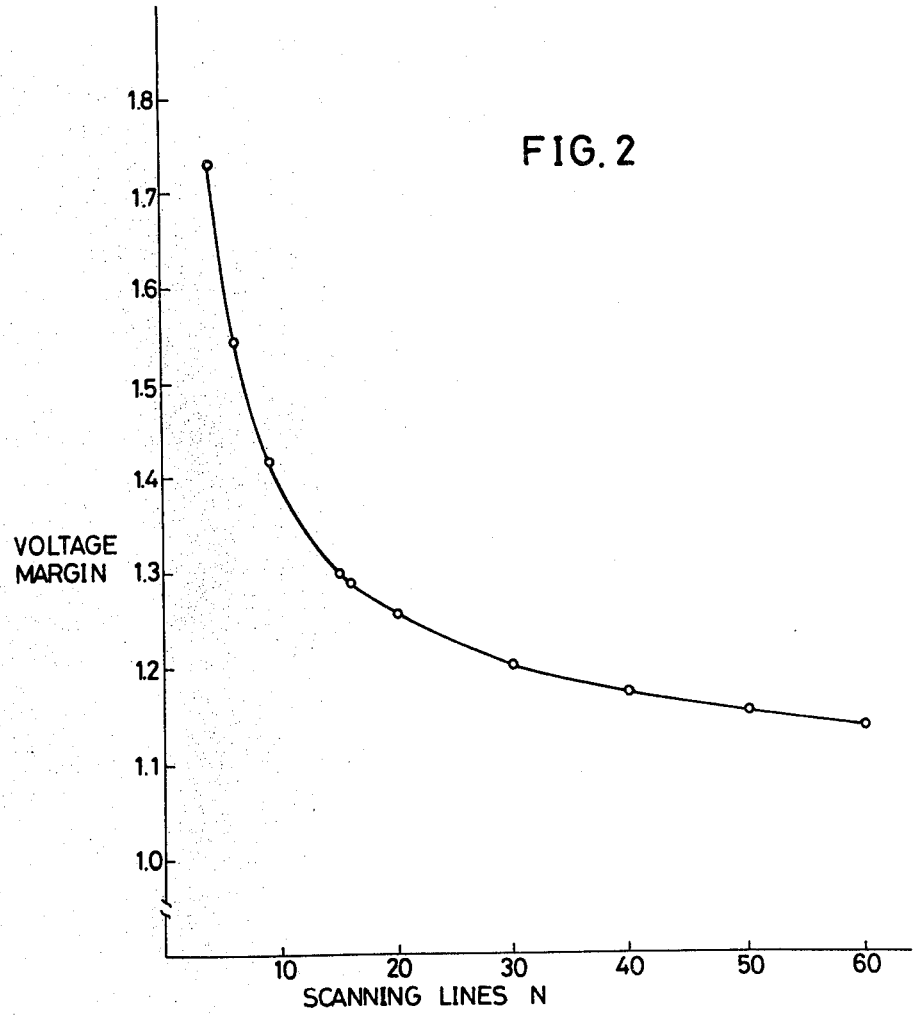
FIG. 2 is a graph showing the relationship between the number of scanning lines and voltage margin.

The liquid crystal panel units 14*a*, 14*b*, 14*c* and 14*d* are each a liquid crystal display capable of displaying 20 characters by 2 rows with the same electrode configuration as shown in FIG. 1 and form as a whole the single panel 14 capable of 20 characters by 8 lines. Although not shown, the liquid crystal panel 14 is typically made up such that two rows of characters form a pair and the column electrodes 1 are subdivided into two groups in a vertical direction to thereby form a pair of the units 14*a* and 14*b* and a pair of the units 14*c* and 14*d* and each of the units are further double-layered.

Corresponding ones of the row electrodes 2 of the liquid crystal display units 14*a*, 14*b*, 14*c* and 14*d* and corresponding ones of the cursor electrodes 3 are connected in common. These row electrodes 2 are scanned in the line sequential scanning fashion by the scanning circuit 17 and then one of the two cursors 3 is selected and driven. This selection is achieved in such a manner that the position where the cursor lines is to be displayed is detected by the cursor line control circuit in the timing circuit 16 as best shown in FIG. 4 and the output of the cursor line control circuit is supplied to the cursor selector 18 and the scanning circuit 17 selects one of the cursor electrodes 3 in response to the output of the cursor line selector 18.

The timing control circuit 16 is a circuit which generates a variety of various timing signals in response to clock pulses from the oscillator 15 and one-character strobe signals from the input/output interface 5. Those timing pulses are fed to the input/output interface 5, the character buffer memory 6, the character generator 7, the parallel-to-serial converter 8, the memory control circuit 10, the line memories 11*a*, 11*b*, 11*c* and 11*d*, the data latches 12*a*, 12*b*, 12*c* and 12*d* and the scanning control circuit 17, while the cursor line control circuit in the timing control circuit 16 supplies a signal indicative of the position for displaying the cursor line to the cursor line selector 18.

Figure 4:
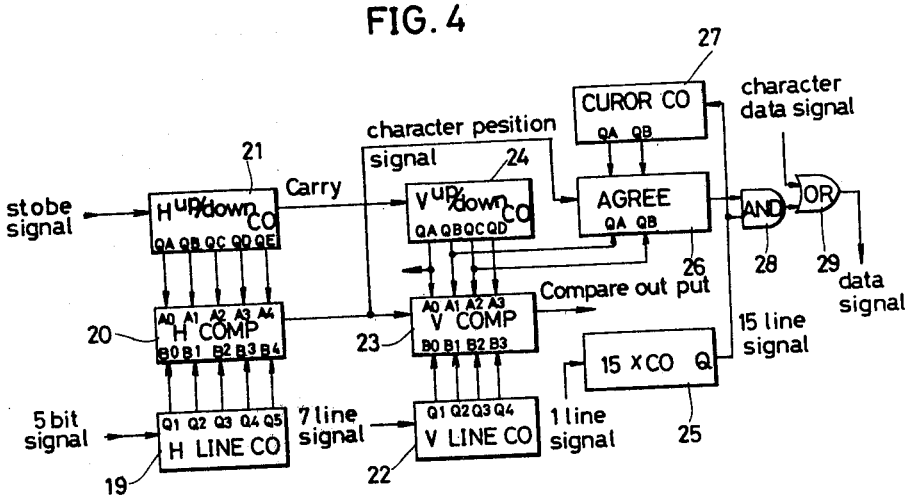
FIG. 4 is a block diagram of a cursor line control circuit.

The cursor line control circuit, as depicted in FIG. 4, includes a 5-bit 1-up horizontal line counter 19, a horizontal comparator 20, a horizontal up/down counter 21, a 7-line 1-up vertical line counter 22, a vertical comparator 23, a vertical up-down counter 24, a radix-of-15 counter 25, a cursor line position agreement detector 26, a cursor line counter 27, an AND gate 28, an OR gate 29, etc.

The driving technique for the above liquid crystal matrix panel 14 will now be described by reference to FIGS. 3 and 4.

A respective one of the pixels corresponds to 1 bit while viewing from the column electrodes 1 of the liquid crystal panel units 14*a*, 14*b*, 14*c* and 14*d*. The timing control circuit 16 of FIG. 3 supplies 5-bit signals to the 5-bit 1-up horizontal counter 19 for transferring each character in a horizontal direction every 5 bits (when each character consists of 5 by 7 dots). The 5-bit signals are introduced into the 5-bit 1-up horizontal counter 19 to count the number of the characters.

The 1-character strobe signals fed via the keyboard 4 of FIG. 3 are sent to and counted by the horizontal up/down counter 21 for detecting the horizontal position of a character introduced via the keyboard 4. The horizontal comparator 20 compares the output of the horizontal line counter 19 and the counterpart of the horizontal up/down counter 21 and sense character position signals.

7-line signals each consisting of 7 line signals as a unit per 7 row electrodes 2 of the liquid crystal panel units 14*a*, 14*b*, 14*c* and 14*d* are transferred from the timing control circuit 5 to the 7-line 1-up vertical line counter 22 to count the number of rows. Carry signals developing per row of the characters are transferred from the horizontal up/down counter 21 to the vertical up/down counter 24 to count the number of rows.

The vertical comparator 23 compares the output of the 7-line 1-up vertical line counter 22 and the output of the vertical up/down counter 24 to sense where the character is next written. The scanning signals generated per line or each of the row lines 2 from the timing control circuit 16 or 1-line signals are supplied to the radix-of-15 counter 25 which is incremented to generate 15-line signals per 15 lines or 15 row electrodes. The 15-line signals are then supplied to increment the cursor line counter 27 by one.

The output of the cursor line counter 27 and part of the output of the vertical up/down counter 24 are led into the cursor line position agreement detector 26 which in turn provides a cursor signals if the both agree. Since the character position signals from the horizontal comparator 20 are also supplied to the cursor position detector 26 under these circumstances, the cursor signal indicates not only the row position but also the horizontal position of the cursor line. Having been gated via the AND gate 28 in response to the 15-line signals, the cursor signal is mixed with the character or numerical data signals via the OR gate 29 into a frame memory data signal.

Figure 5:
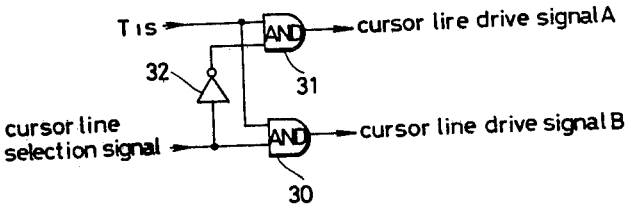
FIG. 5 is a circuit diagram of a cursor selector.
Figure 6:
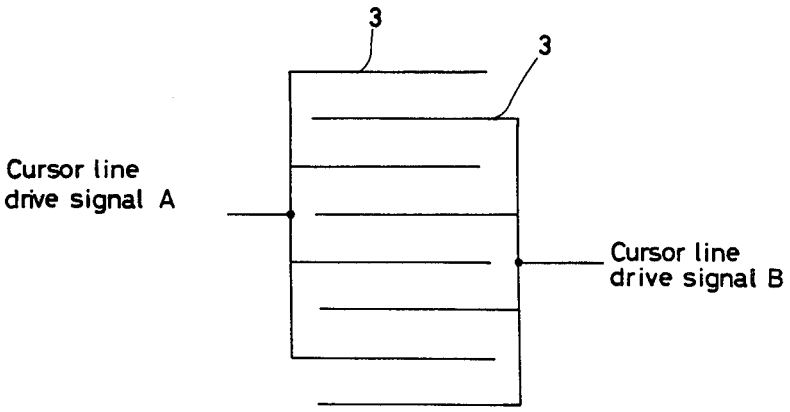
FIG. 6 is a view for explanation of cursor line driving.

A cursor line selection signal from the output $Q_A$ of the vertical up/down counter 24 is a signal which alternates between "0" and "1" each line or row. The cursor line selection signal is supplied to the cursor line selector 18 which includes two AND gates 30 and 31 and an inverter 32 as shown in FIG. 5. When the cursor line selection signal is "0", the AND gate 31 is open to enable the upper of the cursor line electrodes 3 (odd cursor electrodes) of the liquid crystal display units 14*a*, 14*b*, 14*c* and 14*d* as shown in FIG. 6, while the cursor line selection signal of a "1" level enables the even cursor electrodes 3 of the liquid crystal panel 14.

It is clear from the foregoing that the above driving technique eliminates the need for a scanning line for the single cursor line electrode 3 per frame for each of the liquid crystal display units 14*a*, 14*b*, 14*c* and 14*d* with a reduction of a total of the number of the scanning lines.

By way of example, comparison of the above illustrated technique with a multiplexing degree of 15 according to the present invention and the conventional technique with a multiplexing degree of 16 is summarized in the following Table 1.

TABLE 1

| | | |
|---|---|---|
| Multiplexing degree | 16 | 15 |
| Frame memory capacity | 6400 bits | 6000 bits |
| Voltage margin | 1.29 | 1.30 |
| Optimum voltage (scanning side) | $\pm 4\ V_0$ | $\pm 3.87\ V_0$ |

where $V_0$ is the threshold level (peak value) of liquid crystal material on the column electrode side.

It is evident from the above table that the capacity of the frame memory 9 can be reduced from 6400 bits to 6000 bits but the voltage margin be increased from 1.29 to 1.30 according to the present invention. Furthermore, the present invention makes it possible to take a multiplexing degree of 19 rather than 20 in the case of a 7 by 9 dot matrix. It is also obvious that the concept of the present invention is equally applicable to display panels of other materials other than the above discussed liquid crystal material as long as they have separate column electrodes.

With the fact in mind that the cursor line data are displayed on only one of the two cursor electrodes in displaying two rows of characters or numbers on the liquid crystal matrix display panel, the driving technique according to the present invention scans the scanning lines where no cursor line is displayed like the interlaced scanning manner in the art of television transmission. The result is a decrease in the number of the scanning lines and an increase in the voltage margin with high contrast and wide viewing angle properties.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A method for driving a liquid crystal display panel comprising signal lines, scanning lines and pixels at the crossings of the both lines and possessing the dependency of the brightness of its respective pixels on the effective value of applied voltage thereto, said scanning lines being scanned in a line sequential scanning fashion for displaying at least two rows of characters, numbers or symbols as well as a cursor line, said method comprising the following steps of:

scanning said scanning lines in the line sequential scanning fashion two rows by two rows of characters, numbers or symbols; and driving the cursor line on one of said two rows and skipping the cursor on the other row of said two rows during said line sequential scanning.

2. A method according to claim 1 further comprising the step of sensing where the cursor line is displayed.

3. A method for driving a display panel comprising signal lines, scanning lines and pixels at the crossings of the both lines and possessing the dependency of the brightness of its respective pixels on the effective value of applied voltage thereto, said scanning lines being scanned in a line sequential scanning fashion for displaying at least two rows of characters, numbers or symbols as well as a cursor line, said method comprising the following steps of:

scanning said scanning lines in the line sequential scanning fashion two rows by two rows of characters, numbers or symbols; and driving the cursor line on one of said two rows and skipping the cursor on the other row of said two rows during said line sequential scanning.

* * * * *